US005109219A

United States Patent [19]

Kastan et al.

[11] Patent Number: 5,109,219

[45] Date of Patent: Apr. 28, 1992

[54] METHOD AND APPARATUS FOR CONTROLLING AND ADJUSTING THE VIEWING ANGLE OF A LIQUID CRYSTAL DISPLAY

[75] Inventors: Peter Kastan; Donald S. Lamb, Jr, both of Hickory, N.C.

[73] Assignee: Moose Products, Inc., Hickory, N.C.

[21] Appl. No.: 266,475

[22] Filed: Nov. 2, 1988

[51] Int. Cl.[5] ..... G09G 3/18; G09G 3/36

[52] U.S. Cl. ..... 340/765; 340/784; 340/767; 359/54

[58] Field of Search ..... 340/765, 784, 805, 711, 340/767, 793; 350/333; 379/96; 358/241

[56] References Cited

U.S. PATENT DOCUMENTS

| | | | |
|---|---|---|---|
| 4,319,237 | 3/1982 | Matsuo et al. . | |
| 4,370,647 | 1/1983 | Brantingham | 340/784 |
| 4,382,254 | 5/1983 | Ranalli | 340/767 |
| 4,443,819 | 4/1984 | Funada et al. . | |
| 4,479,112 | 10/1984 | Hirsch | 340/767 |
| 4,672,357 | 6/1987 | Lorteije et al. | 340/793 |
| 4,680,674 | 7/1987 | Moore . | |
| 4,744,103 | 5/1988 | Dahlquist et al. . | |
| 4,779,083 | 10/1988 | Ishii et al. | 340/805 |
| 4,839,919 | 6/1989 | Borges et al. | 379/96 |
| 4,859,998 | 8/1989 | Kawamura et al. | 340/784 |

FOREIGN PATENT DOCUMENTS

| | | | |
|---|---|---|---|
| 57115401 | 1/1984 | Japan | 340/784 |

OTHER PUBLICATIONS

Ademco, Ademco's Alpha Vista, 1988.

*Primary Examiner*—Ulysses Weldon
*Assistant Examiner*—M. Fatahiyar
*Attorney, Agent, or Firm*—Bell, Seltzer, Park & Gibson

[57] ABSTRACT

The viewing angle of a liquid crystal display may be controlled by storing a digital code which represents the viewing angle, and converting the stored digital code to an analog voltage which is applied to the bias input of the liquid crystal display. To adjust the viewing angle, a new digital code is stored using keypad input. The invention is particularly suitable for microprocessor controlled displays, and eliminates the need for a hinged or pivoted display, or a viewing angle adjustment knob.

12 Claims, 2 Drawing Sheets

METHOD AND APPARATUS FOR CONTROLLING AND ADJUSTING THE VIEWING ANGLE OF A LIQUID CRYSTAL DISPLAY

FIELD OF THE INVENTION

This invention relates to liquid crystal displays and more particularly to a method and apparatus for controlling and adjusting the viewing angle of a liquid crystal display.

BACKGROUND OF THE INVENTION

Liquid crystal displays (LCDs) are widely used as a display for computer terminals, calculators, security systems and other apparatus. It is known that the scattering characteristic of the liquid crystal depends upon the viewing angle at which an observer views the liquid crystal. Accordingly, many liquid crystal displays are pivotable so that the user may adjust the viewing angle for maximum contrast. For example, U.S. Pat. No. 4,680,674 to Moore describes a modular computer system in which the liquid crystal display is hinged to provide for adjustment of viewing angle, and U.S. Pat. No. 4,443,819 to Funada et al. discloses a liquid crystal TV which is pivotable about its rod antenna to provide adjustment. Unfortunately, a hinge or pivot may create reliability problems, and increase cost and complexity. Furthermore, not all applications of LCD displays will permit a hinged or pivoted display.

It is also known that the viewing angle of a liquid crystal display may be controlled by a bias voltage applied to the liquid crystal. It is therefore common for liquid crystal displays to include a bias input for receiving a bias voltage to control the viewing angle, and a potentiometer or variable resistor to adjust the bias voltage. For example, U.S. Pat. No. 4,744,103 to Dahlquist et al. discloses a telephone which includes an LCD display and a potentiometer for adjusting the viewing angle, and U.S. Pat. No. 4,319,237 to Matsuo et al. discloses a combination of fixed and variable resistors for adjusting the viewing angle of an LCD display.

Unfortunately, a potentiometer is susceptible to contamination and wear, and a potentiometer knob or a thumb screw may be accidently moved. To avoid accidental movement, a recessed adjustment screw may be provided, in which case a screwdriver is needed to adjust the screw. Moreover, present day microprocessor controlled devices, e.g. microwave ovens, video cassette recorders or security systems, avoid the use of any knobs or dials in favor of keyboard-style pushbuttons.

SUMMARY OF THE INVENTION

It is therefore an object of the invention to provide a method and apparatus for controlling and adjusting the viewing angle of a liquid crystal display.

It is a further object of the invention to provide a method and apparatus for controlling and adjusting the viewing angle of a liquid crystal display without requiring a hinged or a pivoted display.

It is yet another object of the invention to provide a method and apparatus for controlling and adjusting the viewing angle of a liquid crystal display without requiring a potentiometer or adjustment screw or knob.

It is yet a further object of the invention to provide a method and apparatus for controlling and adjusting the viewing angle of a liquid crystal display which is compatible with microprocessor control.

It is still a further object of the invention to provide a method and apparatus for controlling and adjusting the viewing angle of a liquid crystal display which adds little to cost or complexity.

These and other objects are satisfied, according to the invention, by storing a digital code which represents a viewing angle of an LCD display, and controlling the viewing angle by converting the stored digital code to an analog voltage which is applied to the LCD bias input. To adjust the viewing angle, a new digital code is stored. Specifically, nonvolatile read/write memory means is provided for storing therein a digital code representing a selected viewing angle for the liquid crystal display. Bias voltage supplying means, for example a digital to analog converter, is connected to the memory and the LCD bias input, and is responsive to the digital code for supplying the bias voltage to the bias input to thereby control the viewing angle of the liquid crystal display. In a preferred embodiment a microprocessor controls storage and retrieval of the digital code, generation of an output signal based on the digital code and application of the output signal to the bias voltage supplying means.

It will be understood by those having skill in the art that the LCD is typically part of a microprocessor controlled apparatus, for example a home security system, so that LCD viewing angle control may be easily integrated into the microprocessor controlled apparatus by adding the bias voltage supplying means and the memory if necessary, and by including appropriate programming for the microprocessor. When the microprocessor controlled apparatus includes a user input means, for example a keyboard or keypad, the viewing angle may be easily adjusted from the keyboard or keypad. Thus, a keypad generated request to adjust the viewing angle will cause the microprocessor to generate a new digital code and store this new digital code in the memory in place of the old digital code. The new digital code is then retrieved, converted to an analog voltage and applied to the LCD. In a preferred embodiment, up/-down keys may be employed to request adjustment of the viewing angle. Upon request, the stored digital code is incremented or decremented, as appropriate, to generate the new digital code. LCD viewing angle adjustment may thus be provided at little additional cost and without using pivots, hinges, potentiometers or knobs.

DESCRIPTION OF THE PREFERRED EMBODIMENT

The present invention now will be described more fully hereinafter with reference to the accompanying drawings, in which a preferred embodiment of the invention is shown. Like characters refer to like elements throughout. This invention may, however, be embodied in many different forms and should not be construed as limited to the embodiment set forth herein; rather, applicants provide this embodiment so that this disclosure will be thorough and complete, and will fully convey the scope of the invention to those skilled in the art.

Figure 1:
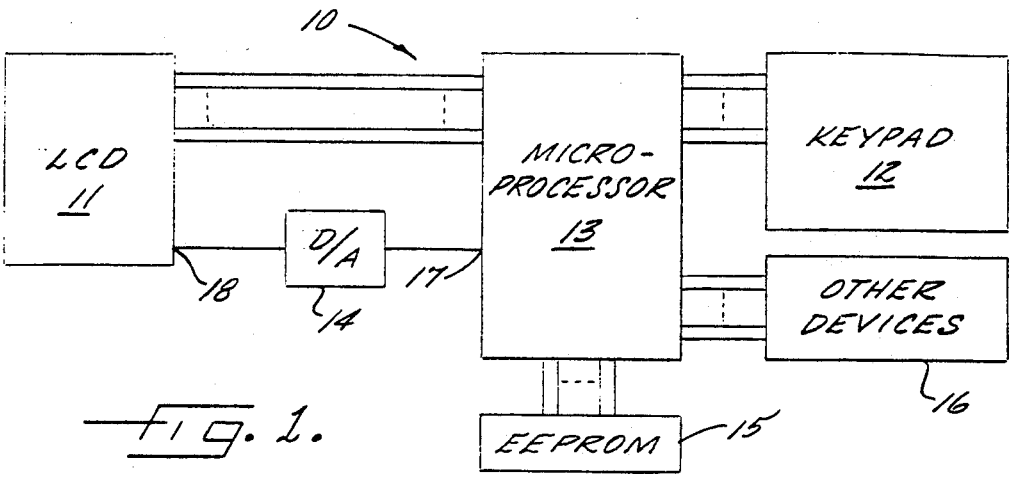
FIG. 1 is a block diagram of a microprocessor controlled apparatus incorporating the present invention.
Figure 2:
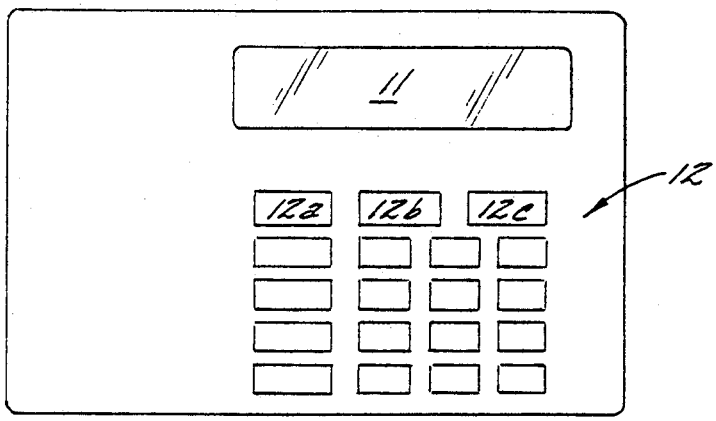
FIG. 2 is a simplified representation of a display and keypad which may be employed with the present invention.

Referring now to FIG. 1, there is shown a simplified block diagram of a microprocessor controlled apparatus 10 which employs the present invention for controlling and adjusting the viewing of an LCD display 11. Microprocessor controlled apparatus 10 may be a display terminal, personal computer, security system, video cassette recorder, microwave oven or any other microprocessor controlled apparatus. Apparatus 10 includes microprocessor 13 for controlling the operation of the apparatus and LCD 11 which includes an LCD bias input 18 for controlling the viewing angle thereof. Apparatus 10 also includes keypad 12 for accepting user inputs. Other devices 16 for example sensors, motors, lasers, etc. may also be connected to the microprocessor 13 for operating the microprocessor controlled apparatus 10.

According to the invention, memory means is provided for storing therein the digital code which represents the selected viewing angle for a LCD display 11. The memory means is preferably a nonvolatile read/-write memory, represented as electrically erasable programmable read only memory (EEPROM) 15. Bias voltage supplying means, represented as digital to analog converter 14 connects a serial digital output 17, of microprocessor 13 and LCD bias input 18. Microprocessor 13 controls LCD viewing angle by reading the stored digital code from EEPROM 15 and generating a signal at serial output 17 based on the stored digital code. D/A converter 14 converts this signal to a bias voltage and supplies the bias voltage to bias input 18.

In the preferred embodiment, LCD viewing angle is stored in EEPROM 15 as a number between 0 and 24. Microprocessor 13 generates the output signal at serial output 17, for example a universal synchronous receiver/transmitter (UART) output, by employing a table lookup based upon the stored digital code. Table 1 illustrates the relationship between the stored digital code in EEPROM 15 and the digital output signal generated by microprocessor 13 at output 17.

TABLE 1

| Stored Digital Code | Digital Output Signal | V27 | V18 |
|---|---|---|---|
| 0 | 11111111 11111111 11111111 | 2.7 | 0 |
| 1 | 11111111 11111111 01111111 | 2.6 | 0.06 |
| 2 | 11111111 01111111 01111111 | 2.5 | 0.12 |
| 3 | 01111111 01111111 01111111 | 2.4 | 0.19 |
| 4 | 01111111 01111111 01110111 | 2.3 | 0.25 |
| 5 | 01111111 01110111 01110111 | 2.2 | 0.31 |
| 6 | 01110111 01110111 01110111 | 2.1 | 0.38 |
| 7 | 01110111 01110111 01100111 | 2.0 | 0.44 |
| 8 | 01110111 01100111 01100111 | 1.9 | 0.50 |
| 9 | 01100111 01100111 01100111 | 1.8 | 0.56 |
| 10 | 01100111 01100111 01010101 | 1.7 | 0.62 |
| 11 | 01100111 01010101 01010101 | 1.6 | 0.69 |
| 12 | 01010101 01010101 01010101 | 1.5 | 0.75 |
| 13 | 01010101 01010101 01000101 | 1.4 | 0.81 |

TABLE 1-continued

| Stored Digital Code | Digital Output Signal | V27 | V18 |
|---|---|---|---|
| 14 | 01010101 01000101 01000101 | 1.3 | 0.88 |
| 15 | 01000101 01000101 01000101 | 1.2 | 0.94 |
| 16 | 01000101 01000101 00010001 | 1.1 | 1.00 |
| 17 | 01000101 00010001 00010001 | 1.0 | 1.06 |
| 18 | 00010001 00010001 00010001 | 0.9 | 1.12 |
| 19 | 00010001 00010001 00000001 | 0.8 | 1.19 |
| 20 | 00010001 00000001 00000001 | 0.7 | 1.25 |
| 21 | 00000001 00000001 00000001 | 0.6 | 1.31 |
| 22 | 00000001 00000001 00000000 | 0.5 | 1.38 |
| 23 | 00000001 00000000 00000000 | 0.4 | 1.44 |
| 24 | 00000000 00000000 00000000 | 0.3 | 1.50 |

Referring to Table 1, it will be seen that the digital output signal is a serial binary signal having 24 bits with the duty cycle being a function of the stored digital code. In particular, the number of ZEROs are equal to the value of the stored digital code. In the preferred embodiment, the pattern of ZEROs are selected so that the ZEROs are evenly spaced among the 24 bits, to thereby reduce the ripple in the digital to analog converter output, as will be described in connection with FIG. 3. Alternatively, the digital output signal may be a pulse width modulated signal in which ONEs and ZEROs are grouped together to produce a pulse, the width of which is proportional to the value of the stored digital code. It will also be understood by those having skill in the art that a parallel digital output signal may be provided, in which case a plurality of microprocessor output lines are required.

Figure 3:
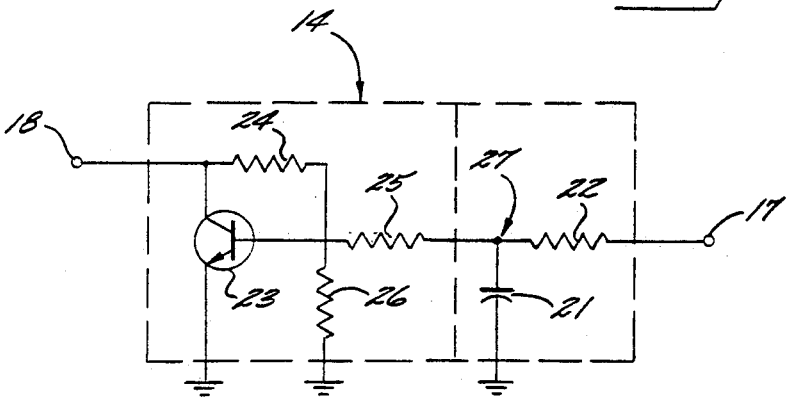
FIG. 3 is a circuit diagram of a digital to analog converter which may be employed with the present invention.

Referring now to FIG. 3, operation of digital to analog converter 14 will now be described. Digital to analog converter 14 includes a resistor/capacitor filter network comprising resistor 22 and capacitor 21. The resistor/capacitor network smooths the digital output signal to provide a constant voltage. The third column of Table 1 illustrates the voltage V27 at point 27 corresponding to the ungrounded terminal of capacitor 21 as a function of the digital output signal. It will be seen that this voltage varies between 0.3–2.7 V depending upon the digital output signal. It will be understood by those having skill in the art that if the binary ZEROs of the digital output signal are grouped together, the voltage V27 will decay as capacitor 27 discharges, thereby creating ripple. Spacing the binary ZEROs in the digital output signal reduces the ripple.

Referring again to FIG. 3 a voltage level converter comprising transistor 23 and resistors 24, 25 and 26 is employed to convert the voltage at point 27 to a voltage at LCD bias input 18 which is within the range specified for the particular LCD display. For example, proper choice of resistors 24, 25 and 26 will provide a voltage V18 at LCD bias input 18 which varies between 0 and 1.5 V as illustrated in Column 4 of Table 1. As an example, when each bit in the digital output signal has a period of 32 μs, the voltages V27 and V18 shown in Table 1 will be obtained when capacitor 21 is 0.1 μf when resistors 22, 24, 25 and 26 are 10KΩ each.

Figure 5:
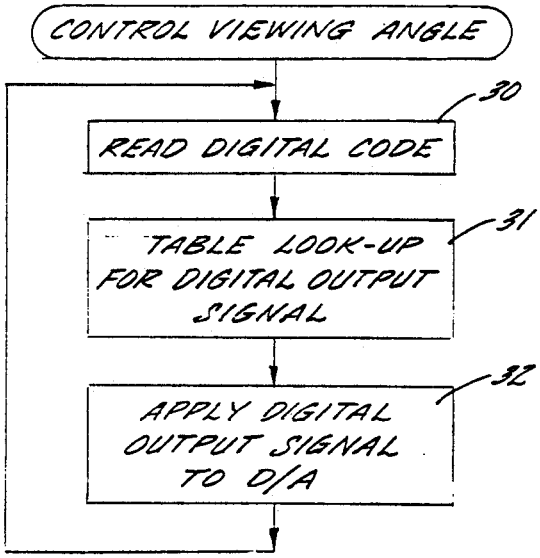
FIG. 5 is a block flow diagram illustrating the logic and a typical sequence of operations to control LCD viewing angle according to the present invention.

Referring now to FIG. 5 the logic and typical sequence of operations for controlling the viewing angle of LCD display 11 according to the present invention will be described. It will be understood by those having skill in the art that the sequence may be performed by a stored program running on microprocessor 13. At block 30, the stored digital code is read from EEPROM 15. Then, at block 31 the microprocessor performs a table lookup to obtain the proper digital output signal, and the signal is applied to the digital to analog converter at block 32. This sequence is continuously repeated in an endless loop, for example at a rate of 400 times per second.

Figure 4:
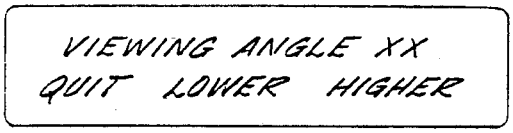
FIG. 4 illustrates information which may be displayed on the LCD display according to the present invention.
Figure 6:
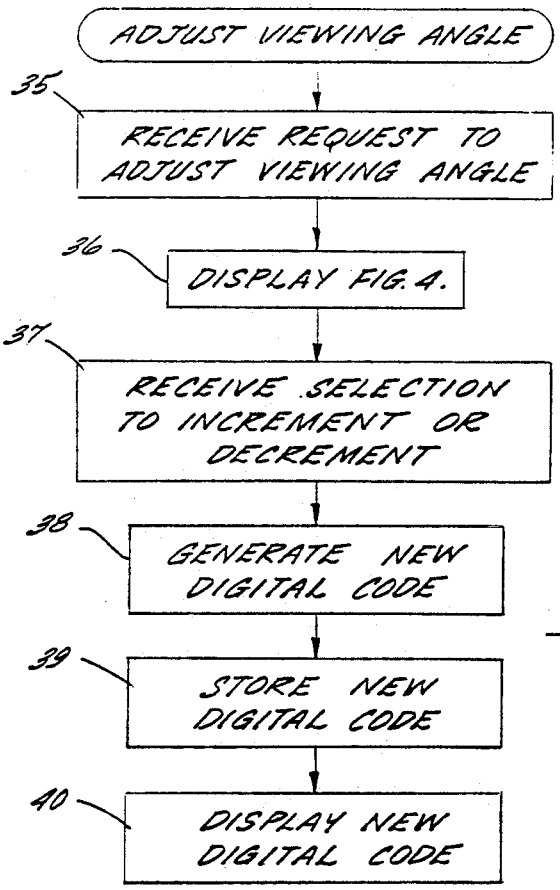
FIG. 6 is a block flow diagram illustrating the logic and a typical sequence of operations to adjust LCD viewing angle according to the present invention.

Referring now to FIG. 6 the logic and typical sequence of operations for adjusting the viewing angle according to the present invention will be described. At block 35, microprocessor 13 receives a user request to adjust the viewing angle. The user request may be provided at keypad 12 by actuating a predetermined combination of keys or a predefined viewing angle adjust key. Upon receipt of the user request to adjust the viewing angle, the display of FIG. 4 is displayed on LCD display 11 (see block 36). Referring now to FIG. 4, the information displayed on the first line of the display is VIEWING ANGLE XX where "XX" is the stored digital code. The words QUIT, LOWER, and HIGHER are displayed on the second line of the display to define the user response for keys 12*a*, 12*b*, and 12*c* respectively. Referring again to FIG. 6 the user selection to decrement or increment the digital code is received by detecting actuation of key 12*b* or 12*c* respectively (block 37). Then at block 38 the microprocessor adds or subtracts 1 from the digital code to generate a new digital code, and stores the new digital code in EEPROM 15 (block 39). The new digital code may be displayed on line 1 of FIG. 4, with the new viewing angle being set by the continuously repeating sequence of FIG. 5, to thereby enable the user to confirm that a desired viewing angle has been obtained.

It will be recognized by those having skill in the art that logic sequences other than described in FIG. 5 and FIG. 6 may be employed. For example, a method of controlling the viewing angle may involve only one read of the digital code and a continuous output of the table lookup signal. A digital code may be read from EEPROM 15 only when the code is changed.

Having described the invention, it will thus be recognized by those having skill in the art that control and adjustment of LCD viewing angle may be provided by adding an EEPROM and D/A converter to a microprocessor controlled apparatus. The EEPROM may already be present for storing other apparatus data so that the viewing angle code may be stored at no additional cost. The sample D/A converter adds little cost. Accordingly, LCD viewing angle may be controlled and adjusted without the need for potentiometers, pivots, hinges or knobs.

In the drawings and specification, there have been disclosed typical preferred embodiments of the invention and, although specific terms are employed, they are used in a generic and descriptive sense only and not for purposes of limitation, the scope of the invention being set forth in the following claims.

That which we claim:

1. A microprocessor controlled apparatus comprising:

a liquid crystal display having a display information input for receiving information for display on said liquid crystal display, and a bias input for receiving a bias voltage to control the viewing angle of said display information;

multiple bit viewing angle memory means, having a selected multiple bit digital code stored therein which represents a selected one of a series of successive incremental viewing angles of said display information on said liquid crystal display;

a microprocessor, connected to said liquid crystal display and said multiple bit viewing angle memory means, for providing said display information to said display information input, for generating and storing said selected multiple bit digital code in said multiple bit viewing angle memory means, for retrieving said selected stored multiple bit digital code from said multiple bit viewing angle memory means, and for generating an output signal based upon said selected stored multiple bit digital code;

bias voltage supplying means, connecting said microprocessor to said bias input, and responsive to said output signal, for supplying said bias voltage to said bias input to thereby control the viewing angle of said display information on said liquid crystal display to said selected viewing angle from said series of successive incremental viewing angles; and data input means connected to said microprocessor for accepting a user request to incrementally adjust said selected viewing angle of said liquid crystal display from said series of successive incremental viewing angles;

said microprocessor further comprising means responsive to said user request at said data input means for generating and storing a new selected multiple bit digital code in said multiple bit viewing angle memory means to incrementally adjust said selected viewing angle from said series of successive incremental viewing angles.

2. The apparatus of claim 1 wherein said output signal is a digital output signal and wherein said bias voltage supplying means comprises a digital to analog converter for converting said digital output signal into said bias voltage.

3. The apparatus of claim 2 wherein said output signal is a pulse-width modulated signal with the width of said multiple bit pulse being a function of said digital code, and wherein said digital to analog converter converts said pulse width modulated signal into said bias voltage.

4. The apparatus of claim 3 wherein said digital to analog converter is a resistor/capacitor filter network.

5. The apparatus of claim 2 wherein said output signal is a serial binary signal having a predetermined number of bits, with the number of bits of a first binary value being a function of said multiple bit digital code, and wherein said digital to analog converter converts said serial binary signal into said bias voltage.

6. The apparatus of claim 5 wherein said digital to analog converter is a resistor/capacitor filter network.

7. The apparatus of claim 1 wherein said microprocessor further comprises means, responsive to said user request to adjust the viewing angle of said display information on said liquid crystal display, for displaying said display information on said liquid crystal display at a new viewing angle corresponding to said new multiple bit digital code, to thereby enable the user to confirm that a desired viewing angle has been obtained.

8. The apparatus of claim 1 wherein said multiple bit viewing angle memory means comprises a nonvolatile read/write memory.

9. The apparatus of claim 1 wherein said apparatus is a microprocessor controlled security system.

10. In a microprocessor controlled apparatus including a liquid crystal display having a display information input for receiving information for display on said liquid crystal display, and a bias input for receiving a bias voltage to control the viewing angle of said display information, a method for controlling said viewing angle comprising the steps of:

storing, under control of said microprocessor, a multiple bit digital code which represents a selected one of a series of successive incremental viewing angles of display information on said liquid crystal display;

converting said multiple bit digital code to a bias voltage;

applying said bias voltage to said bias input to thereby control the viewing angle of said display information on said liquid crystal display to said selected viewing angle from said series of successive incremental viewing angles;

accepting, under control of said microprocessor, a user request to incrementally adjust the viewing angle of said display information on said liquid crystal display from said series of successive incremental viewing angles; and generating and storing, under control of said microprocessor, a new selected multiple bit digital code from the accepted user request to incrementally adjust the selected viewing from said series of successive incremental viewing angles.

11. The method of claim 10 wherein said applying step is followed by the step of:

displaying information on said liquid crystal display at a viewing angle corresponding to said multiple bit digital code.

12. The method of claim 10 wherein the method is practiced in a microprocessor controlled security system.

* * * * *